United States Patent [19]

Dreischmeier

[11] Patent Number: 4,921,511

[45] Date of Patent: May 1, 1990

[54] DEVICE FOR CLEANING FLUFF SCREENS OF AN APPARATUS FOR SMOOTHING ARTICLES OF CLOTHING

[75] Inventor: Wilfried Dreischmeier, Vlotho, Fed. Rep. of Germany

[73] Assignee: Herbert Kannegiesser GmbH & Co., Vlotho, Fed. Rep. of Germany

[21] Appl. No.: 175,379

[22] Filed: Mar. 30, 1988

[30] Foreign Application Priority Data

Mar. 31, 1987 [DE] Fed. Rep. of Germany ..... 3710636
May 30, 1987 [DE] Fed. Rep. of Germany ..... 3718257

[51] Int. Cl.[5] ..... B01D 46/04
[52] U.S. Cl. ..... 55/294; 55/302
[58] Field of Search ..... 55/96, 294, 302

[56] References Cited

U.S. PATENT DOCUMENTS 2,516,680 7/1950 Culpepper ..... 55/294
4,153,008 5/1979 Marino et al. ..... 55/290
4,266,953 5/1981 Matthys et al. ..... 55/294
4,277,264 7/1981 Buckholz et al. ..... 55/294

FOREIGN PATENT DOCUMENTS 3224948 12/1983 Fed. Rep. of Germany .

*Primary Examiner*—Bernard Nozick
*Attorney, Agent, or Firm*—Sughrue, Mion, Zinn, Macpeak & Seas

[57] ABSTRACT

In the cleaning of (fluff) screens (17) of an apparatus for smoothing articles of clothing by means of flowing media, the fluff (fluff carpet 19) is sucked off from the fluff screen (17) by means of a suction nozzle (21). To improve the suction effect, blowing air (compressed air) is additionally conveyed through the fluff screen (17) from below in the region of suction via blowing pipes (25, 26). The suction nozzle (21) and the blowing pipes (25, 26) are connected to one another to form the jointly movable cleaning unit (20). This is moved over the fluff screen (17) at intervals of time.

15 Claims, 5 Drawing Sheets

DEVICE FOR CLEANING FLUFF SCREENS OF AN APPARATUS FOR SMOOTHING ARTICLES OF CLOTHING

BACKGROUND OF THE INVENTION

The invention relates to a process for cleaning fluff-collecting screens (fluff screens) in an apparatus for smoothing articles of clothing, the fluff being removed from the top side of the fluff screen from time to time as a result of suction. The invention also relates to a device for cleaning (fluff) screens by sucking off the fluff, in an apparatus for the treatment of articles of clothing.

The invention is therefore concerned with the design of apparatuses for smoothing articles of clothing, especially for the simultaneous drying and smoothing of washed articles of clothing by means of flowing media, such as steam and hot air. An exemplary embodiment of an apparatus of this type is illustrated and described in German Offenlegungsschrift No. 3,224,948. The articles of clothing to be treated, suspended on clothes-hangers, are conveyed through the tunnel-like apparatus. Steam and hot air are directed onto the articles of clothing from above. The flowing media are guided over a fluff screen arranged in the lower region, fluff thereby being filtered out.

In the known apparatus for the treatment of articles of clothing (so-called finishers), the fluff screen is cleared of the fluff from time to time by means of a suction box which is moved over the fluff screen. The performance of this suction box has not proved adequate to free fluff from the fluff screen to a sufficient extent, particularly within short cleaning times.

SUMMARY OF THE INVENTION

The object on which the invention is based is, therefore, to improve an apparatus for the treatment of articles of clothing with regard to the cleaning of fluffcollecting screens (fluff screens), in such a way that the cleaning of these can be carried out with a high cleaning effect and within the shortest possible time.

To achieve this object, the process according to the invention is characterized in that the fluff is removed from the top side of the fluff screen as a result of simultaneous equidirectional suction (on the top side of the fluff screen) and blowing (compressed air) (from the underside of the fluff screen).

Accordingly, in the invention, the suction of the fluff from the top side of the fluff screen is improved considerably by means of blowing air taking effect additionally from below in the region of suction.

In the device according to the invention for cleaning fluff screens by suction, blowing nozzles are arranged on the (bottom) side of the fluff screen located opposite the fluff and, in the region of the suction device or in the region of a suction nozzle of this, blow blowing air through the fluff screen into the suction device or suction nozzle.

The interaction of the suction and the blowing air in terms of time and place ensures that the fluff lifts off from the fluff screen reliably and can be removed from the treatment chamber via the suction nozzle with the adjoining suction line.

The blowing nozzles are arranged in (two) blowing pipes which extend underneath the fluff screen transversely relative to this and which are immediately next to one another and opposite the suction nozzle of the suction device. The screen accordingly extends in the region of the cleaning device between the suction nozzle and the blowing pipes. Since the relatively thin, flexible fluff screen consisting of a fine-steel fabric or an other material rests on a firm base, it is lifted off from the base by the blowing pipes during and in the region of the suction.

According to the invention, the suction device and blowing pipes form a jointly movable unit with running rollers arranged and guided laterally or at the ends next to the fluff screen, as part of a running carriage. This is driven to and fro in the longitudinal direction of the treatment chamber, preferably by means of a cable mechanism engaging on the running carriage on one side.

The air drawn off by means of the suction line via the suction nozzle and containing fluff is conveyed through a fluff container outside the treatment chamber and is filtered in this. The purified air finally returns to the treatment chamber again completely or partially.

The cleaning of the screen by sucking off the fluff takes place at intervals. For this purpose, there is preferably an automatic control which activates the cleaning unit as a function of the number of treated articles of clothing, specifically for one to-and-fro cycle of movement each time. The number of articles of clothing critical for the cleaning of the screen can be set individually, especially according to the type of textiles. On average, cleaning is necessary after the treatment of approximately 150 to 200 articles of clothing.

The fluff screen rests on a screen support, in particular a supporting grid. Installed above the cleaning device or suction device is a walk-on floor permeable to air and fluff and consisting especially of a walk-on grating.

Further features of the invention relate to the arrangement of the fluff screen and to the design and mode of operation of the cleaning device and its drive.

An exemplary embodiment of the invention is explained in more detail below with reference to the drawings. In these:

DETAILED DESCRIPTION OF A PREFERRED EMBODIMENT

Figure 1:
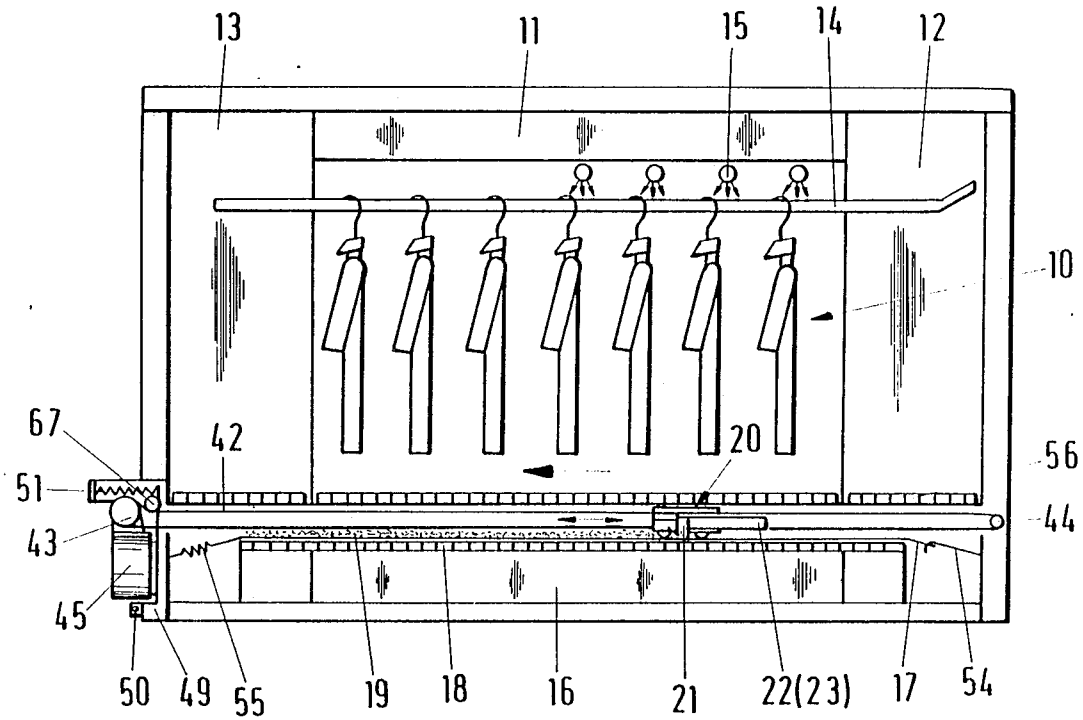
FIG. 1 shows a diagrammatic longitudinal section through an apparatus for smoothing articles of clothing with a cleaning unit for the fluff screen.

In FIG. 1, the apparatus for smoothing articles of clothing 10 is shown only diagrammatically. The interior of the apparatus is divided into three regions, namely an elongate tunnel-like treatment chamber 11 and a feed chamber 12 and discharge chamber 13 arranged respectively in front of and behind this in the direction of transport of the articles of clothing 10. The articles of clothing 10 are conveyed, suspended on clothes-hangers, through the chambers 12, 11 and 13 by means of a transport device 14, for example a screw conveyor.

In the treatment chamber 11, steam and hot air, preferably in the form of steam-containing hot air, are blown onto the articles of clothing 10 from above. For this purpose, transversely directed steam pipes 15 with outflow nozzles pointing downwards are arranged above the path of movement of the articles of clothing 10. A flow of a medium directed downwards from above is therefore generated inside the treatment chamber 11. Arranged in the lower part of the apparatus, especially in the lower region of the treatment chamber 11, is a collecting chamber 16, which the stream of steam-containing hot air enters after it has flowed past the articles of clothing 10. Steam and hot air are circulated inside the apparatus in a closed circuit, specifically, if necessary, with spent air being removed and fresh air being added.

The medium flowing through the treatment chamber 11 is conveyed through a fluff screen 17 for the purpose of cleaning, especially separating out fluff. This is located in the lower part of the treatment chamber 11 and of the adjacent regions of the feed chamber 12 and discharge chamber 13. The fluff screen extends virtually over the entire width of the apparatus or of the treatment chamber 11.

In the present exemplary embodiment, the fluff screen 17 consisting preferably of a fine-steel fabric is designed as an elongate, rectangular mat which is stretched under a certain prestress over an air-permeable base fixed in place. In the present case, this consists of a supporting grid 18 extending above the collecting chamber 16. The medium (steam-containing hot air) accordingly flows through the fluff screen 17 and then through the supporting grid 18 into the collecting chamber 16. Fluff and other solid particles contained in the flowing medium are retained on the top side of the fluff screen 17 and there gradually form a fluff carpet 19.

The fluff screen 17 is cleaned at intervals of time, specifically as a result of suction exerted on the fluff carpet 19. For this purpose, a cleaning unit 20 is moved in the longitudinal direction over the fluff screen 17, at the same time absorbing and sucking off the fluff. A cleaning cycle consists of a to-and-fro movement of the cleaning unit 20, specifically from an initial position shown on the left in FIG. 3 and an end position.

An essential part of the cleaning unit 20 is a suction nozzle 21 extending transversely over the fluff screen 17. This suction nozzle 21 is designed essentially as an elongate, cuboid hollow box, with an open underside for the inflow of the fluff and with a central, lateral connection piece 22 for a hose-like suction line 23. The open underside of the suction nozzle is at the same time the slit-shaped nozzle orifice 24 extending transversely over the entire width of the fluff screen 17. This nozzle orifice 24 is moved at a predetermined distance above the fluff screen, so that the fluff can enter the suction nozzle 21 in the most effective possible way.

The suction effect of the suction nozzle 21 is assisted by blowing air which is blown through the fluff screen 17 from below in the region of the suction nozzle 21. The blowing air is preferably set at a pressure (during blowing) of 2.5 bars to 3 bars. The blowing-air flow is pointed directly towards the nozzle orifice 24 of the suction nozzle 21.

In the present exemplary embodiment, the blowing air is supplied directly underneath the fluff screen 17 via (two) blowing pipes 25, 26. The blowing pipes 25, 26 designed as round hollow bodies pressed flat extend immediately next to one another transversely relative to the fluff screen 17, specifically approximately centrally relative to the suction nozzle 21. In edge regions facing one another, the blowing pipes 25, 26 are each equipped, approximately centrally relative to the nozzle orifice 24, with a row of blowing nozzles 27 arranged next to one another transversely relative to the fluff screen 17. These are arranged close next to one another, so that blowing air directed upwards and passing through the fluff screen 17 is generated over the entire length of the blowing pipes 25, 26.

The combined effect of the blowing air and suction ensures that the fluff lifts off from the top side of the fluff screen 17 reliably and can enter the suction nozzle 21 and be removed via the connection piece 22 and the suction line 23.

The blowing pipes 25, 26 are combined into a blowing unit of relatively small constructional height and are covered by a U-shaped covering section 28 open downwards. The blowing pipes 25, 26 are connected to this section 28 in the region of a horizontal web wall 29 of the section 28. This section 28 is equipped, in the region of the blowing nozzles 27, with passage bores 30 of larger diameter for the blowing air.

The blowing unit described above is underneath the fluff screen 17. Accordingly, when a cleaning movement is executed, the blowing unit is moved underneath the fluff screen 17 lifted off slightly from the supporting grid 18. The web wall 29 of the covering section 28 at the same time slides along on the underside of the fluff screen 17.

The flow paths and flow orifices in the region of the suction nozzle 21 are aligned and can be adjusted to achieve the best possible suction effect. For this purpose, the nozzle orifice 24, on the longitudinal side (as seen transversely relative to the fluff screen 17), is equipped with an adjustable outflow slide 31. The primary function of this is to seal off the space underneath the nozzle orifice 24 laterally. This is ensured by means of an elastic sealing member of the outflow slide 31, in particular a sealing strip 32 made of elastic material, especially silicone. The sealing strip 32 rests on the fluff screen 17 with slight pressure, specifically on the latter on the rear side of the suction nozzle 21 during the first phase of movement of a cleaning cycle.

Figure 4:
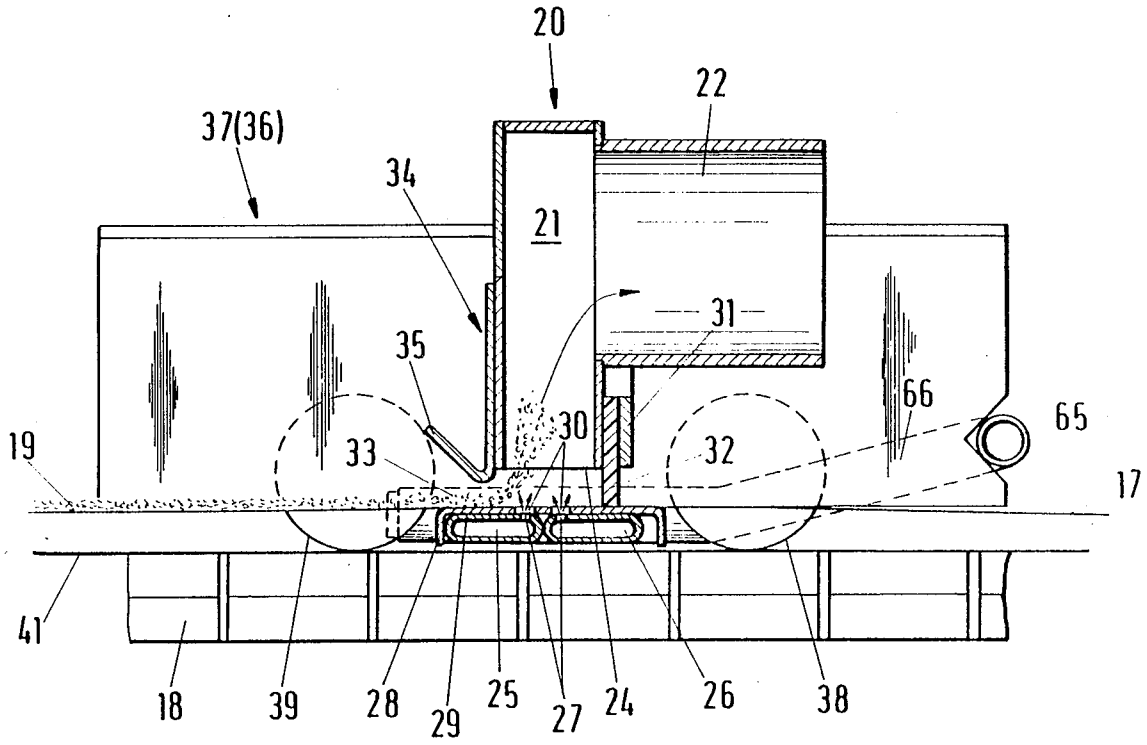
FIG. 4 shows a cross-section through the cleaning unit on a further-enlarged scale.

Formed on the opposite front side of the suction nozzle 21 is a slit-shaped inflow orifice 33 which has a larger dimension in terms of height than the fluff carpet 19, so that the latter enters the region underneath the nozzle orifice 24 during the movement of the cleaning unit 20. The slit-shaped inflow orifice 33 is limited at the top by a likewise adjustable inflow slide 34 consisting of an angled or bent plate with a funnel-shaped inflow leg 35 directed upwards. A Teflon film is appropriately glued to the inflow slide 34. The normal position is such that the inflow orifice 33 is at a height of 4 mm (the distance between the lower edge of the inflow leg 35 and the fluff screen 17). The quantity of blowing air supplied via the blowing pipes 25, 26 is smaller than the quantity of air sucked up by the suction nozzle 21, because, as shown in FIG. 4, the suction nozzle opening (24) has a larger cross-sectional area than that of the combined cross-sectional areas of the nozzle openings of all of the blowing nozzles (27). Consequently, air is also drawn via the inflow orifice 33.

Figure 5:
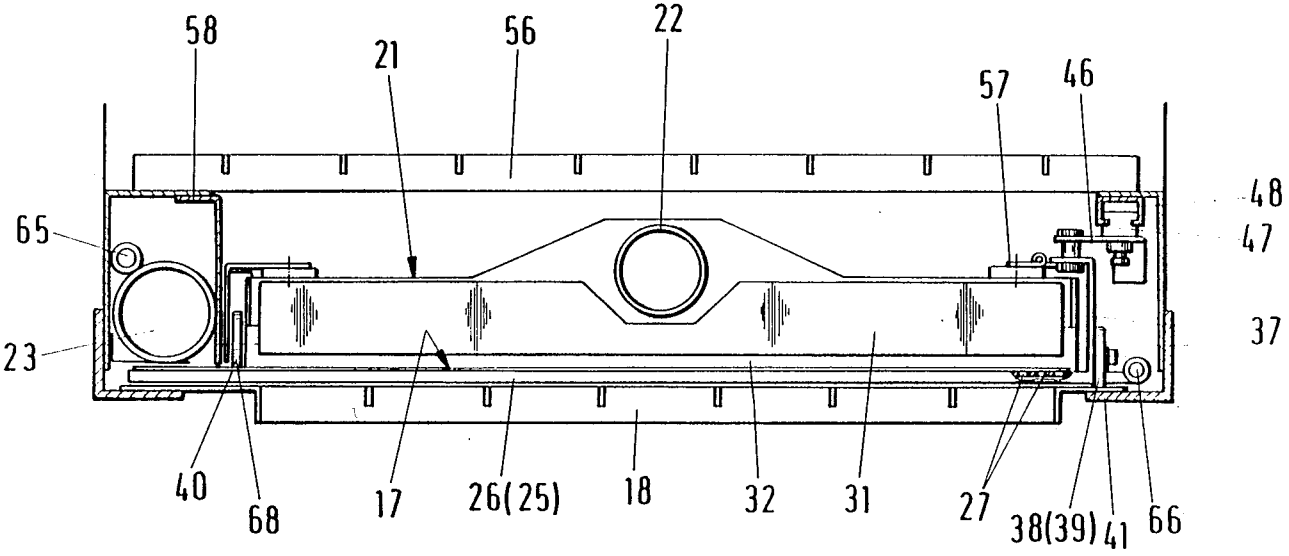
FIG. 5 shows a cross-section through the lower region of the apparatus according to the sectional line A—A of FIG. 2 on an enlarged scale.

The suction nozzle 21 and blowing unit (blowing pipes 25, 26) are connected to one another to form the jointly movable U-shaped cleaning unit 20, in particular by means of the running carriage 37 (located on the right: in FIG. 5) with the running rollers 38, 39. The running carriage 37 is supported or runs on the roller track 41. On the opposite side of the cleaning unit there is a further running carriage 36 with a running roller 67, but without a mechanical connection to the blowing unit. The running carriage 36 is supported or runs on the roller track 40 formed there by the blowing unit (blowing pipes 25, 26) and by the fluff screen 17. This ensures that the nozzle orifice 24, the inflow orifice 33 and the sealing strip 32 of the outflow slide 31 of the suction nozzle 21 are always at the same set distance from the fluff screen 17.

Figure 2:
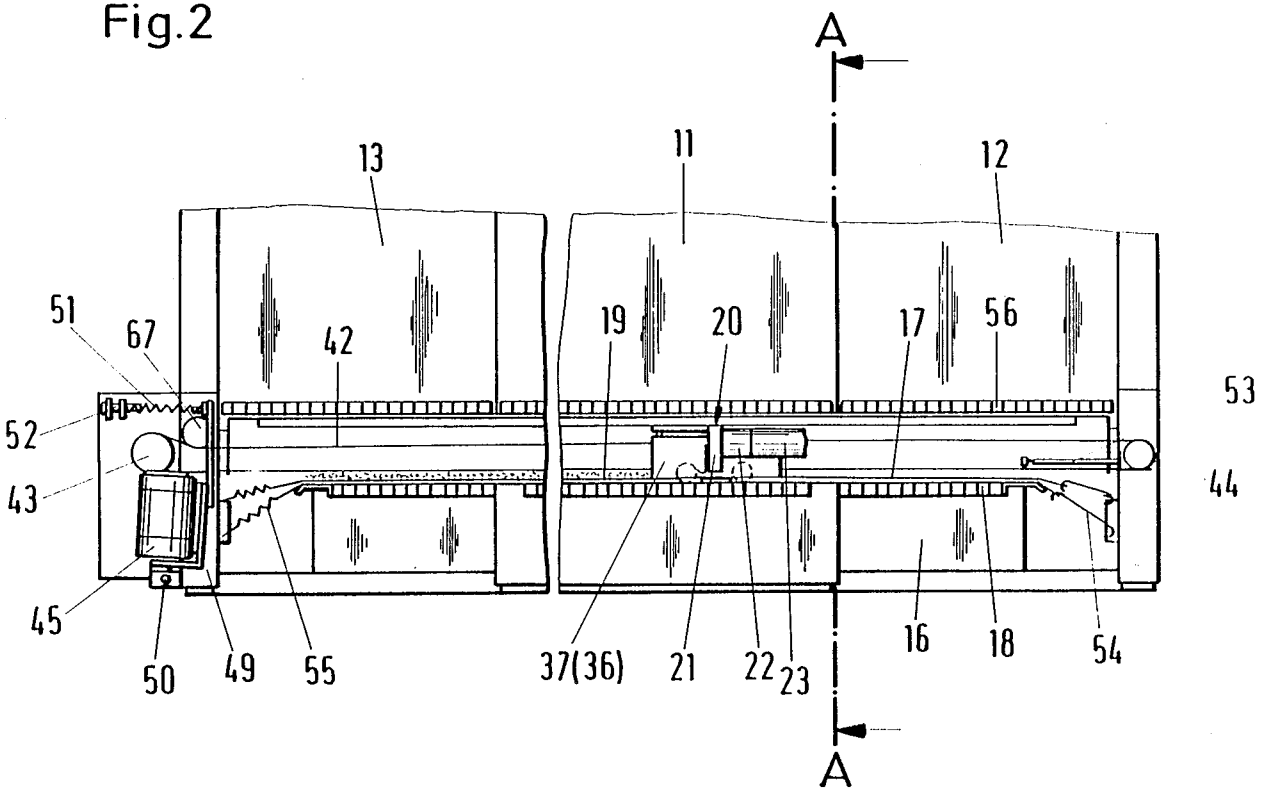
FIG. 2 shows the lower region of the apparatus according to FIG. 1 on an enlarged scale.

In the present exemplary embodiment, the cleaning unit 20 is driven to and fro by means of a cable mechanism with an endless pulling cable 42. This is guided outside the apparatus or at the edge of the latter via deflecting rollers 43, 44, 67. The (larger) deflecting roller 43 arranged longitudinally in the representation of FIG. 2 is at the same time a drive roller which is gear-connected to a drive motor 45 (geared motor).

The cable mechanism or pulling cable 42 is connected to the cleaning unit 20 on one side only, that is to say in an off-center manner. In the present exemplary embodiment, the cable mechanism is located on the side opposite the suction line 23 (on the right in FIG. 5). The pulling cable 42 is connected to the running carriage 37, specifically by means of a laterally directed fastening arm 46 with a fastening and guide piece 47 made of plastic, especially Teflon. The fastening and guide piece 47 runs by means of an upper head piece in a C-shaped guide rail 48 extending in the longitudinal direction laterally next to the path of movement of the cleaning unit 20. The fastening and guide piece 47 is held positively and slidably in the guide rail 48. As a result of this design, the drive can be transmitted to the cleaning unit 20 without any tilting.

The pulling cable 42 is maintained under prestress to ensure a slip-free drive of the cleaning unit 20. For this purpose, the driven deflecting roller 43, together with the drive motor 45, is mounted on a pivotable rocker 49. The rocker 49 is tiltable about a pivot bearing 50 arranged underneath the drive motor 45. The upper free end of the rocker 49 is held so as to be adjustable via a spring element, in particular a tension spring 51. For this purpose, the free end of the tension spring 51 is connected to a threaded rod 52, by means of which the tension of the tension spring 51 and consequently the tension of the pulling cable 42 can be adjusted as a result of rotation.

The cleaning movement of the cleaning unit 20 is preferably controlled automatically, specifically as a function of the number of articles of clothing 10 passing through the apparatus. For example, a cleaning cycle car be initiated whenever 150 to 200 articles of clothing have passed through. In this, the cleaning unit 20 is moved out of the initial position in the region of the feed chamber 12 to the opposite side and back again (FIGS. 1 and 2). The entire cleaning cycle can amount to approximately 70 seconds. In the reversal position, the cleaning unit 20 runs onto fixed microswitches with an actuating tappet 53.

Since the fluff screen 17 is lifted slightly during the cleaning movement, it is fixed elastically to the supporting grid 18 by special retention means. In the present exemplary embodiment, the fluff screen 17 is fastened at one end by means of hook-in mountings 54 and at the opposite end by means of likewise hook-in tension springs 55.

The walk-on capacity of the apparatus, including the collecting chamber 16, is guaranteed by an upper air-permeable cover in the form of a load-bearing grating 56. This extends immediately above the cleaning unit 20. The grating 56 can be removed in order to carry out cleaning and repair work. The cleaning unit 20 can be tilted into a vertical position (FIG. 5) about a hinge joint 57 on the running carriage 37.

Figure 3:
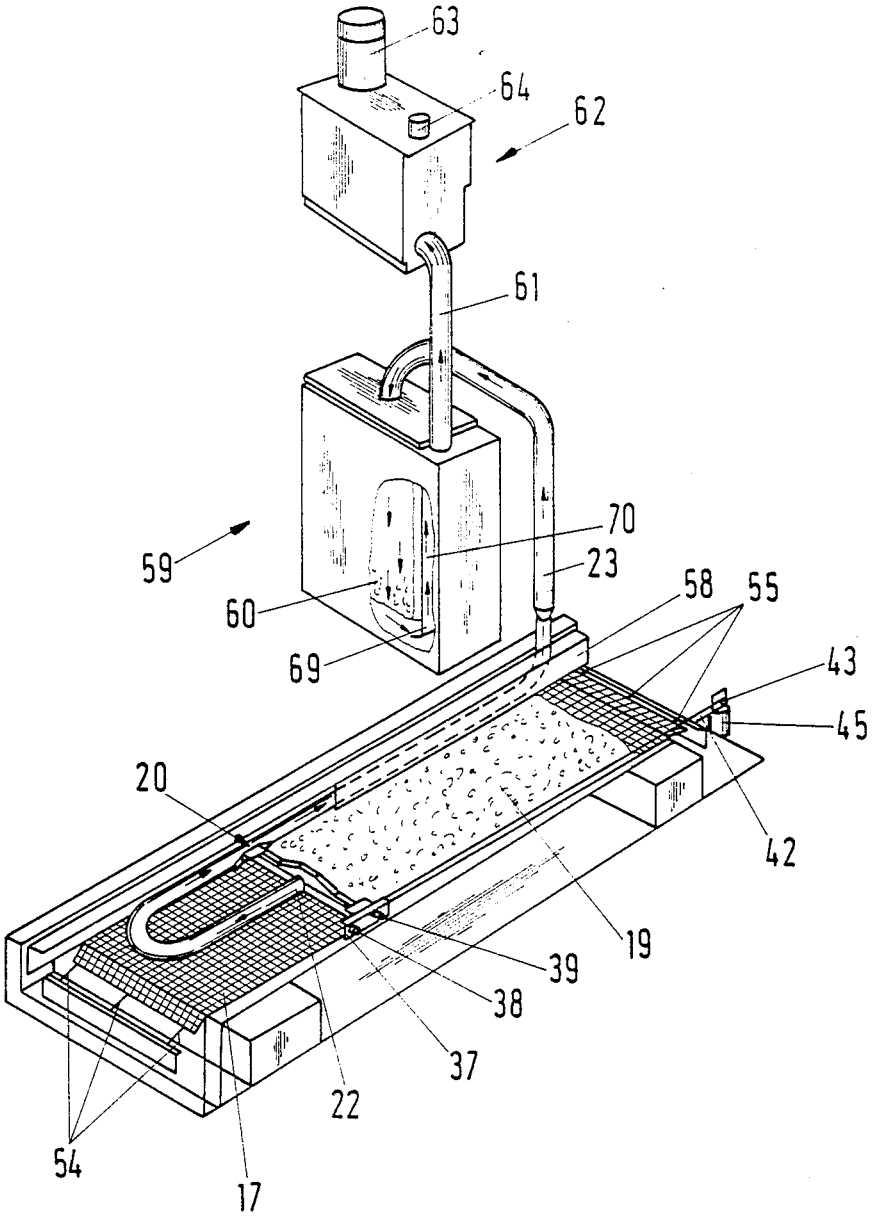
FIG. 3 shows a perspective representation of the lower region of the apparatus with a cleaning unit, a fluff container and a suction unit.

The suction line 23 consisting of a hose sheathed with a steel spiral is connected to the suction nozzle 21 laterally or at the rear and, during the cleaning movement, rests partially on the fluff screen 17 in a U-shaped manner (FIG. 3). That part of the suction line 23 further away from the suction nozzle 21 extends laterally on or next to the fluff screen 17, but at all events next to the cleaning unit 20 and the running carriage 36. That part of the suction line which is not deformed in a U-shaped manner during the cleaning movement is located in a lateral channel-shaped cover 58 next to the fluff screen 17.

Outside the collecting chamber 16, the suction line 23 enters a fluff container 59. Inside this, the fluff is filtered out of the air. For this purpose, the air is conveyed through a filter bag 60 inside the fluff container 59, so that the fluff is largely retained in the filter bag 60. The filler bag 60 is connected, in the upper region, to the inflow end of the suction line 23 via a releasable coupling (not shown). The filter bag 60 can be exchanged by releasing this connection. Within the fluff container 59, the filter bag 60 is also separated by means of a partition wall 69 from the air channel 70 located at the side of this.

The air freed of fluff is fed via a connecting hose 61 to a suction unit 62. Inside this is a blower or a fan which generates the suction air and which is driven by a flanged-on motor 63. When the air enters the suction unit 62, fine filtering takes place, so that fine dust particles and fluff particles still present in the air are filtered out. The air now completely purified can be released via a blow-out connection 64 or returned to the treatment chamber 11 as a treatment medium via a return line (not shown).

The blowing air can be supplied to the blowing pipes 25, 26 in a suitable way, specifically via a deformable compressed-air line 65 which, in the present case, is likewise arranged partially under the cover 58, next to or above the suction line 23. The hose-like compressed-air line 65 is guided onto the side located opposite the cover 58 and there is connected to the blowing-air connection 66 for the blowing pipes 25, 26.

What is claimed is:

1. Device for cleaning a fluff-collecting, stationary fluff screen of a treatment chamber of an apparatus for smoothing articles of clothing, comprising:

a fluff screen 17 a cleaning unit (20), movable over the fluff screen (17), for sucking off fluff, from time to time, from the top side of the longitudinal horizontal fluff screen (17);

a suction nozzle (21) disposed in the cleaning unit (20) and extending transversely over the fluff screen (17) at the top side of the fluff screen;

a blowing air unit (24–30), disposed in the cleaning unit (20) and on a side opposite the suction nozzle (21) directly underneath the fluff screen (17), for directing blowing air against the underside of the fluff screen (17);

said blowing air unit (24–30) comprising at least one blowing pipe (25, 26) extending parallel to the suction nozzle (21) and having a plurality of blowing nozzles (27) which are distributed in the transverse direction of the screen (17), and through which blowing air is guided in the direction of the suction nozzle (21); and driving means (37, 42, 45) for moving said cleaning unit (20), containing said suction nozzle (21) and said blowing air unit (24–30), over the fluff screen (17).

2. Device according to claim 1, comprising: a suction line (23), in the form of a flexible hose, coupled to the suction nozzle (21) and bent in a U-shaped manner; and means for guiding said suction line (23) in a horizontal plane laterally next to the fluff screen (17) in the longitudinal direction of the treatment chamber (11), said guiding means comprising a lateral channel-shaped cover (58).

3. Device according to claim 1, comprising a fixed lower support grid 18; and wherein said fluff screen is an elongate finite fluff screen (17) which consists of a deformable fabric made of fine steel and which is stretched under elastic prestress over said fixed lower supporting grid (18), the blowing pipes (25, 26) extending between the fluff screen (17) and the supporting grid (18).

4. Device according to claim 1, wherein the blowing air unit underneath the fluff screen (17) comprises two blowing pipes (25, 26), each having a flat upper surface and a row of blowing nozzles (27) therein which are arranged in peripheral regions of the blowing pipes (25, 26) so that corresponding blowing nozzles (27), in the respective blowing pipes (25, 26), face one another.

5. Device according to claim 1, wherein the blowing pipes (25, 26) are covered by a U-shaped covering section (28) that is open downwards and has, in an upper horizontal web wall (29) thereof, passage bores (30), corresponding to the blowing nozzles (27), for passing the blowing air.

6. Device according to claim 1, wherein the nozzle opening (24) of said suction nozzle (21) has a larger crosssectional area than that of the combined cross-sectional areas of the nozzle openings of all of said blowing nozzles (27).

7. Device according to claim 1, wherein said driving means comprises a running carriage (37) with lateral running rollers (38, 39); wherein the suction nozzle (21) and blowing pipes (25, 26) are combined in said cleaning unit (20) by means of said running carriage (37) with said lateral running rollers (38, 39), and during the cleaning of the fluff screen (17) said running carriage is guided, resting on the blowing pipes (25, 26), through between the suction nozzle (21) on the one hand and the blowing pipes (25, 26) on the other hand.

8. Device according to claim 7, wherein said driving means further comprises a cable mechanism, a pulling cable, a drive motor and deflecting rollers; and wherein: the cleaning unit (20) is movable to and fro in the longitudinal direction through the treatment chamber and part regions of a feed chamber (12) and discharge chamber (13) by means of said cable mechanism; and said pulling cable (42) is connected to the cleaning unit (20), laterally to said running carriage (37), and is guided via said deflecting rollers (43, 44, 67), one of which is driven by said drive motor (45).

9. Device according to claim 8, comprising an adjustable tensioning member and an adjustable tension spring; and wherein the pulling cable (42) is under adjustable elastic prestress, as a result of an arrangement of a driven deflecting roller (43) on said adjustable tensioning member which is in the form of a pivotable rocker (49) which is pivotable by means of said adjustable tension spring (51), thereby tensioning the pulling cable (42).

10. Device according to claim 8, comprising a guide rail and a fastening and guide piece; and wherein in the region of the laterally connected pulling cable (42), the cleaning unit (20) is guided positively in said guide rail (48), extending in the longitudinal direction of the treatment chamber (11), by said fastening and guide piece which is connected to the cleaning unit (20) and which projects positively into said guide rail (48).

11. Device according to claim 1, comprising a fluff container and a filter bag; and wherein the air sucked off by the suction nozzle (21) and containing fluff is conveyed through said fluff container (59) and filtered therein through said filter bag (60) arranged removably inside said fluff container (59).

12. Device according to claim 11, comprising a suction unit (62) with a blower or fan; and wherein the fluff container (59) is followed by said suction unit (62) with a blower or fan for generating the suction air and for returning same to the treatment chamber (11) after previous fine filtering.

13. Device according to claim 1, wherein the suction nozzle (21) is elongated transversely over the fluff screen (17) and is sealed off laterally relative to the fluff screen (17) with the exception of a slit-shaped inflow orifice (33) for permitting entry of a fluff carpet (19) in a region underneath said suction nozzle (21), said fluff carpet (19) being formed by fluff retained on the top side of said fluff screen (17).

14. Device according to claim 13, wherein the inflow orifice (33) is formed on the front side of the suction nozzle (21) relative to the movement of the cleaning unit (20) during a first cleaning phase, and is limited by a vertically adjustable inflow slide (34) with an inflow leg (35) turned down in a funnelshaped manner.

15. Device according to claim 14 and, comprising a vertically adjustable outflow slide (31), with an elastic sealing strip (32), arranged on the side of the suction nozzle (21) located opposite the inflow orifice (33), the sealing strip (32) resting on the top side of the fluff screen (17) with slight pressure.

* * * * *